US006338211B1

(12) United States Patent
Carney

(10) Patent No.: US 6,338,211 B1
(45) Date of Patent: Jan. 15, 2002

(54) MEMORIAL MARKER FOR STAKING IN A GRAVE

(76) Inventor: Mary Lou Carney, 51 Ward St., West Islip, NY (US) 11795

( * ) Notice: Subject to any disclaimer, the term of this patent is extended or adjusted under 35 U.S.C. 154(b) by 0 days.

(21) Appl. No.: 09/754,542

(22) Filed: Jan. 4, 2001

(51) Int. Cl.[7] ..... G09F 19/00

(52) U.S. Cl. ..... 40/124.5; 40/124.11; 40/607; 248/156

(58) Field of Search ..... 40/124.5, 124.01, 40/124.06, 124.11, 606, 607; D99/17, 18; 248/530, 156; 52/103, 104

(56) References Cited

U.S. PATENT DOCUMENTS

| | | | | | |
|---|---|---|---|---|---|
| 1,310,369 | A | | 7/1919 | Palmer | |
| 1,364,902 | A | * | 1/1921 | Sullivan | 40/124.5 |
| 1,400,970 | A | * | 12/1921 | Norman | 40/124.5 |
| 1,455,882 | A | * | 5/1923 | Harding | 40/124.5 |
| 1,526,381 | A | * | 2/1925 | Slawson | 40/124.5 |
| 2,017,335 | A | | 10/1935 | Adams | |
| 2,023,519 | A | * | 12/1935 | Durrett et al. | 40/124.5 |
| 2,193,747 | A | | 3/1940 | Thompson | |
| 2,332,217 | A | * | 10/1943 | Harner | 40/124.5 |
| 2,663,104 | A | | 12/1953 | Hoagland | |
| 3,608,220 | A | * | 9/1971 | Fryrear | 40/124.5 |
| 3,977,110 | A | | 8/1976 | Yerger | |
| 4,079,530 | A | | 3/1978 | Atherton et al. | |
| 4,196,533 | A | | 4/1980 | Kamphausen | |
| 4,285,149 | A | * | 8/1981 | Berryhill | 40/124.5 |
| 4,304,059 | A | | 12/1981 | Tisbo et al. | |
| 4,516,344 | A | | 5/1985 | Seely | |
| 4,584,213 | A | | 4/1986 | Rentowl | |
| 4,685,233 | A | | 8/1987 | Hull | |
| 4,946,039 | A | | 8/1990 | Garran | |
| 5,042,183 | A | * | 8/1991 | Kennedy | 40/607 |
| 5,181,335 | A | * | 1/1993 | Todd | 40/607 |
| 5,366,192 | A | | 11/1994 | Carroll | |
| D360,733 | S | * | 7/1995 | Aylsworth | D99/18 |
| 5,454,178 | A | | 10/1995 | Rivard | |
| D376,890 | S | | 12/1996 | Caldwell | |
| D386,880 | S | * | 11/1997 | Vaske | D99/18 |
| 5,682,696 | A | * | 11/1997 | Gill | 40/606 |
| 5,771,614 | A | | 6/1998 | Dawson | |
| 5,891,576 | A | | 4/1999 | Imai et al. | |

FOREIGN PATENT DOCUMENTS

| | | |
|---|---|---|
| GB | 16401 | 1/1912 |
| GB | 2243012 | 10/1991 |

* cited by examiner

*Primary Examiner*—B. Dayoan
*Assistant Examiner*—William L. Miller
(74) *Attorney, Agent, or Firm*—Richard L. Miller

(57) ABSTRACT

A memorial marker that includes a cap, that is attached to the uppermost end of a rod and is a conventionally-oriented five point star that has a pair of lowermost pointed arms that depend skewly outwardly from the rod, and which equidistantly straddle, and clear, the uppermost end of the rod, and as a result thereof, allows a left half to be releasably captured between the pair of lowermost pointed arms and the uppermost end of the rod so as to maintain the card in a closed mode thereof when a left half of the card is folded onto a right half of the card, and the card is moved vertically upwardly on the rod, and the left half of the card is flexed and engaged between the pair of lowermost pointed arms and the uppermost end of the rod.

14 Claims, 1 Drawing Sheet

MEMORIAL MARKER FOR STAKING IN A GRAVE

BACKGROUND OF THE INVENTION

1. Field of the Invention

The present invention relates to a memorial marker. More particularly, the present invention relates to a memorial marker for staking in a grave.

2. Description of the Prior Art

Numerous innovations for markers have been provided in the prior art that will be described. Even though these innovations may be suitable for the specific individual purposes to which they address, however, they differ from the present invention.

A FIRST EXAMPLE, U.S. Pat. No. Des. 376,890 to Caldwell teaches the ornamental design for a memorial marker.

A SECOND EXAMPLE, U.S. Pat. No. 1,310,369 to Palmer teaches a marker having a casing comprising a metallic sheet having its upper, lower, and one side edge bent rearwardly and connected together to define grooves. The sheet has an enlarged central display opening and an outstruck portion surrounding the opening. A plate of similar contour as that of the sheet slidably fits in the grooves from the remaining side of the sheet, and a bendable tongue carried by the latter mentioned side edge of the sheet and adapted to be arranged against the rear of said plate.

A THIRD EXAMPLE, U.S. Pat. No. 2,017,335 to Adams teaches a device comprising a frame having a socket in one side and an opening in an opposite side communicating with the socket and being less in width than the width of the socket, a transparent member sealed to the rear wall of the socket about the opening, a display carrier behind the transparent member, a plate in the socket having a central boss thereon, and a support attached to the frame and adapted to engage the boss on the plate and press the plate and the carrier firmly against the transparent member.

A FOURTH EXAMPLE, U.S. Pat. No. 2,193,747 to Thompson teaches a signal comprising a staff having a flag at its upper end, a base member having an offset terminating in a flange which is adapted to receive means for its connection to a post. The offset locates the staff to one side of said post. A spring coupling joins the lower end of the staff to the base member. The member stands at a pitch in respect to the flange and leans toward the post, causing the staff to incline away from the vertical and toward the axis of the post. A signal comprises a staff, and a base member having a flange to receive means for its connection to a support. The base member has an offset locating the staff to one side of the support. A spring coupling joins the staff to the base member, and a flag plate is rigidly secured to the top of the staff in permanent substantial line with the offset.

A FIFTH EXAMPLE, U.S. Pat. No. 2,663,104 to Hoagland teaches in combination, a hollow column and a display card. The column is polygonal in cross section and has integral end flaps turned inside the column around the upper edge thereof. The display card has a zone for bearing desired indicia, a tongue projecting from one edge of the zone and inserted inside the column, a first pair of tabs extending laterally outwardly along one side of said tongue, and a second pair of tabs extending laterally outwardly from the other side of said tongue. The tabs are separated from adjacent tabs by laterally extending slits and from the zone by laterally extending slits. The tabs of each of the pairs are folded in opposite directions to lie against the inside of the column. The length of each of said tabs by which the tabs project outwardly beyond the tongue is substantially equal to one-half of the width of the column along the line which the tabs lie. The lowermost of the tabs fitting under the lower edges of said end flaps of said column, whereby said display card is locked against disengagement from said column.

A SIXTH EXAMPLE, U.S. Pat. No. 3,977,110 to Yerger teaches a decorative marker particularly suited for use as a grave marker. The marker comprises a one-piece molded rigid plastic assembly with an embossed decorative metalized legend on the front surface and four axially aligned bosses on the rear surface adapted for securely mounting the marker to a ground support rod and for support of a removable flagstaff.

A SEVENTH EXAMPLE, U.S. Pat. No. 4,079,530 to Atherton et al. teaches an identification marker as a garden market to indicate crop rows. The marker has an elastic backing including a plate having a front first label support surface, an elongated stake mounted to the bottom of the plate and depending downwardly therefrom, and a supporting rib integral with back surfaces of the plate and stake and extending rearwardly therefrom. A frame as adapted for selected face-to-face contact with the plate. The frame includes an inner frame portion which defines a display opening, and an outer frame portion surrounding the inner frame portion. An outer frame portion back surface abuts the plate front surface during said selected contact, while an inner frame portion back surface, parallel to and forward with respect to the outer frame back surface, comprises a second label support surface. A retaining wall is between the inner and outer frame back surfaces. The marker further includes means for maintaining said selected face-to-face contact. The means are adapted to allow slidable insertion of a display label or seed pack through a passageway between the frame and the plate to a display position wherein the label is supported between the first and second label supporting surfaces inwardly of the retaining wall, one face of the label being viewable through the display opening.

AN EIGHTH EXAMPLE, U.S. Pat. No. 4,196,533 to Kamphausen teaches a plant or garden marker comprising a stake element preferably of plastic material having a stem or shank portion with a sharp point at one end thereof and an enlarged planar mounting surface at the opposite end thereof. An identification member such as a decal is removably applied to the mounting surface and serves to identify plants by means of graphic information or indicia or both. The identification member also can be a sheet element provided with pressure sensitive adhesive. The mounting surface is outlined by a rib-like formation which outlines the location of the identification member. Various identification members can be purchased separately according to different varieties of plants the user intends to grow, and a selected member is affixed to a stake element which then is driven by hand into the ground adjacent the plant or plants to be identified. The same stake element can be used with different identification members simply by removing an old one and replacing it with a new member. The shank portion is reinforced by a pair of rib-like elements extending thereal-ong of generally U-shaped cross section.

A NINTH EXAMPLE, U.S. Pat. No. 4,304,059 to Tisbo et al. teaches an improved open face garden market which is a molded unitary plastic device. The instant market includes an open continuous ring having a plurality of ears formed integral with the interior of the ring extending inward. The ears are staggered for receiving an indicating indicia between the ears and holding the indicia between the ears. A shank is formed integral with the continuous ring and extends outward from the ring. The shank has a point on one end for engagement with the earth to facilitate insertion of the marker into the earth. Measuring indicia is formed integral with the shank for indicating depth of insertion of the shank into earth.

A TENTH EXAMPLE, U.S. Pat. No. 4,584,213 to Rentowl teaches a commemorative card that is formed from water impervious or water resistant material and is provided with means for mounting at least one fresh or artificial flower thereon. Where the card is to carry a fresh flower or flowers, means for supplying moisture to the flower or flowers, such as a water-retentive hard foamed plastics material, may be provided to keep the flower or flowers fresh. The water retentive material may be mounted in a pocket or recess formed at the rear of the card, the flower stem or stems passing through an aperture in the card. A region is provided on the face of the card which is receptive to ink so that a message or signature may be written on the card, while the card as a whole is resistant to moisture.

A ELEVENTH EXAMPLE, U.S. Pat. No. 4,685,233 to Hull teaches a portable yard sign adapted for easy storage, transport and assembly, which is simple to install and remove from a soil bed, without special equipment, and which consists of a rigid upright post having a longitudinal slot extending downwardly from its top edge, and a main sign panel having a foldable side edge corresponding to and insertable into the slot for securing the panel to the post, the post having on its bottom end a ground stake and foot plate assembly for penetration into the soil bed upon application of foot pressure thereon. The main panel foldable side edge may be formed by scoring an edge of the panel and cutting tabs along the folded edge, or by connecting a hinged member along an edge of the panel. A modified embodiment of the invention may utilize an inverted L-shaped post with the slot for receiving an edge of the sign panel formed in the post leg parallel to the ground and the sign panel hanging from the post leg toward the ground A TWELFTH EXAMPLE, U.S. Pat. No. 4,946,039 to Garran teaches a sign display kit including a flexible transparent waterproof plastic container which contains the other materials in the kit; i.e. a sign, a stake, a rubber band for mounting the sign on the stake, and optionally one or more rubber balloons. The container is an envelope or bag formed from two plies of plastic sheet. The sign has a front surface which can be marked with a marking instrument, and which has on the front surface a printed message and a space in which handwritten information can be filled in. The stake is tapered at one end for driving into the ground. The printed message announces an event which is a cause for celebration, such as a birth, and may rear "It's a Boy" or "It's a Girl". The baby's name is filled in by hand, using a suitable marking instrument. The plastic container may be placed over the sign to form a waterproof cover therefor. The stake may be driven into the ground and the sign secured to the stake by looping the rubber band around the stake immediately above and immediately below the sign. The stake is behind the sign and the rubber band is in front in the assembled display.

A THIRTEENTH EXAMPLE, U.S. Pat. No. 5,366,192 to Carroll teaches a stand for holding a message or felicitation card vial and flower that includes a generally planar base having a front edge and an upright plate extending upwardly from the front edge of the base, and having a top edge and a front face which faces forwardly of the front edge of the base, where the upright plate includes tabs for holding the card flat against the front face of the plate. Extending rearwardly of the top edge of the upright plate is an annulus which defines a circular opening, and on which is mounted a sleeve extending vertically upwardly from about the opening, directly above the base. A vial having an open upper end and a closed lower end is provided for disposition in the sleeve so that the closed lower end rests on the base and the open upper end is directed upwardly to receive and hold the stem of a flower.

A FOURTEENTH EXAMPLE, U.S. Pat. No. 5,454,178 to Rivard teaches a plaque or medallion marker which is serially stackable and rotatably mountable onto a stake, rod or post for insertion into the ground or other base material. A second medallion and subsequently additional medallions may be stackably mounted onto stacking rods. The additional medallions may stackably mount at angles such as 30 degrees, 45 degrees, 60 degrees etc. from the vertical direction as measured from the top of the medallion. The medallion/markers may be used typically at grave sites or may be used to identify any region or site. The material is of such composition and finish so as to withstand weathering and to substantially retain the original aesthetic. More particularly the medallion is circular with defined regions or zones. There is an innermost zone representing the existence within the individual of the most fundamental interests of the individual during his/her lifetime and in which there may be placed appropriate indicia signifying such values and interest. An inner zone which completely borders on the innermost zone but having an inner boundary distinct from the boundary defining the innermost zone. The inner zone is further defined by an outer boundary. There is additionally a medallion boundary separate and distinct from the inner zone outer boundary but substantially contiguous therewith signifying the existence of a relationship between the individual's inner attributes and values and all relationships outside of the "soul" or persona of the individual.

A FIFTEENTH EXAMPLE, U.S. Pat. No. 5,771,614 to Dawson teaches a floral assembly, which may be included in a card, is made of absorbent paper in the shape of a flower having an upper end flared as a bloom-shaped seed pocket and the lower end is a stem-shaped support. The pocket contains seeds for germination and may be easily opened to free them for growth. When the stem is immersed in water, it serves as a wick to moisten the upper part of the assembly and helps start the seeds germinating.

A SIXTEENTH EXAMPLE, U.S. Pat. No. 5,891,576 to Imai et al. teaches a card having a paper as a base material laminated with decomposable plastic layers having such properties as durability, banding resistance, water resistance, chemical resistance, waterproofness, surface smoothness, glossiness end workability. Any visible information design portion and/or a magnetic recording portion may be formed as required. The present invention improves the durability of a card using paper as a base material and provides the card which spontaneously decomposes even when left after being discarded.

A SEVENTEENTH EXAMPLE, United Kingdom Patent No. 16,401 to Bennett teaches a metallic folding ornamental memorial sign for graves to be used in place of the ordinary grave stone now in common use.

AN EIGHTEENTH EXAMPLE, United Kingdom Patent No. 2,243,012 to James, et. al. teaches a support system for flora or other decorative articles providing a joint comprising a ball in a socket, the ball being connected to a support for a floral or decorative arrangement and the socket being connected to a handle or other engageable part, the ball and socket joint permitting of moving the support for the flora or other decorative article relative to the handle.

It is apparent that numerous innovations for markers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a memorial marker for staking in a grave that avoids the disadvantages of the prior art.

ANOTHER OBJECT of the present invention is to provide a memorial marker for staking in a grave that is simple and inexpensive to manufacture.

STILL ANOTHER OBJECT of the present invention is to provide a memorial marker for staking in a grave that is simple to use.

BRIEFLY STATED, STILL YET ANOTHER OBJECT of the present invention is to provide a memorial marker that includes a stake, a panel, and a cap. The stake is a rod that has a lowermost end for sacking into the grave, and an uppermost end. The panel is a card that is rectangular-shaped and has a vertical fold line that divides the card equally into a right half and a left half. The right half of the card has a front surface, a rear surface, and a pair of throughslots, wherein the rod extends vertically along the front surface thereof, up through the second throughslot therein, vertically along the rear surface thereof, up through the first throughslot therein, and back vertically along the front surface thereof. The cap is attached to the uppermost end of the rod and is a conventionally-oriented five point star that has a pair of lowermost pointed arms that depend skewly outwardly from the rod, and which equidistantly straddle, and clear, the uppermost end of the rod, and as a result thereof, allows the left half to be releasably captured between the pair of lowermost pointed arms and the uppermost end of the rod so as to maintain the card in the closed mode thereof when the left half of the card is folded onto the right half of the card, and the card is moved vertically upwardly on the rod, and the left half of the card is flexed and engaged between the pair of lowermost pointed arms and the uppermost end of the rod.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
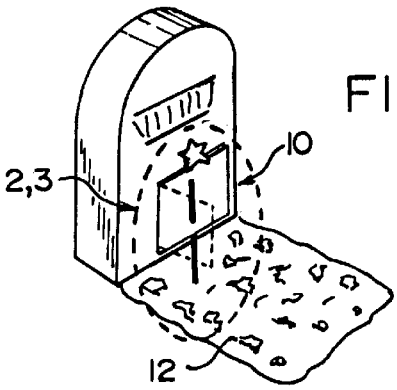
FIG. 1 is a diagrammatic perspective view of the present invention in use.

10 memorial marker of present invention for staking in grave 12
12 grave
14 stake for staking in grave 12
16 panel
18 rod of stake 14
20 lowermost end of rod 18 of stake 14 for sacking into grave 12
22 uppermost end of rod 18
24 card of panel 16
26 uppermost long edge of card 24 of panel 16
28 lowermost long edge of card 24 of panel 16
30 leftmost short edge of card 24 of panel 16
32 rightmost short edge of card 24 of panel 16
34 fold line of card 24 of panel 16
36 right half of card 24 of panel 16
38 left half of card 24 of panel 16
40 back surface of card 24 of panel 16
42 front surface of card 24 of panel 16
43 memorial indicia on back surface 40 of card 24 of panel 16
44 first throughslot in right half 36 of card 24 of panel 16
45 memorial indicia on front surface 42 of card 24 of panel 16
46 second throughslot in right half 36 of card 24 of panel 16
48 cap for maintaining card 24 in closed mode thereof
50 conventionally-oriented five point star of cap 48
52 rear surface of conventionally-oriented five point star 50 of cap 48
54 uppermost pointed arm of conventionally-oriented five point star 50 of cap 48
56 pair of sidemost pointed arms of conventionally-oriented five point star 50 of cap 48
58 pair of lowermost pointed arms of conventionally-oriented five point star 50 of cap 48

DETAILED DESCRIPTION OF THE PREFERRED EMBODIMENT

Referring now to the figures, in which like numerals indicate like parts, and particularly to FIG. 1, the memorial marker of the present invention is shown generally a 10 for staking in a grave 12.

Figure 2:
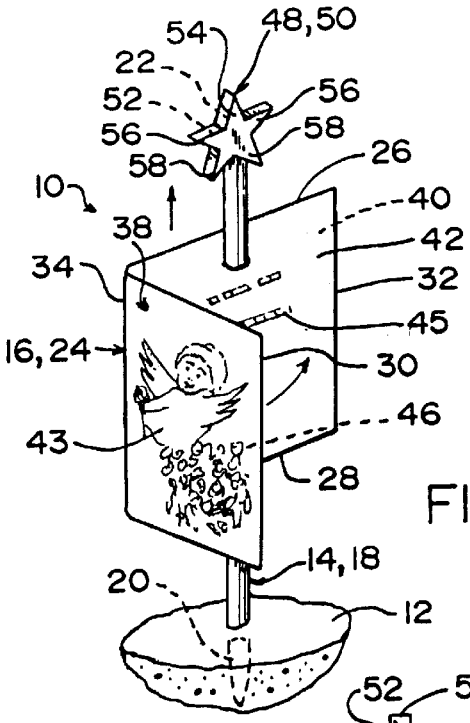
FIG. 2 is an enlarged diagrammatic perspective view of the area generally enclosed by the dotted curve identified by arrow 2 in FIG. 1 of the present invention, in the open mode.
Figure 3:
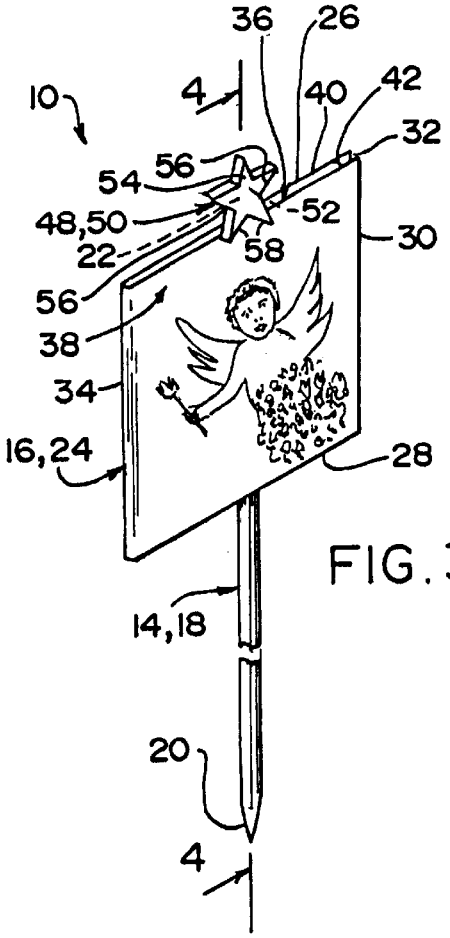
FIG. 3 is an enlarged diagrammatic perspective view of the area generally enclosed by the dotted curve identified by arrow 3 in FIG. 1 of the present invention, but in the closed mode.
Figure 4:
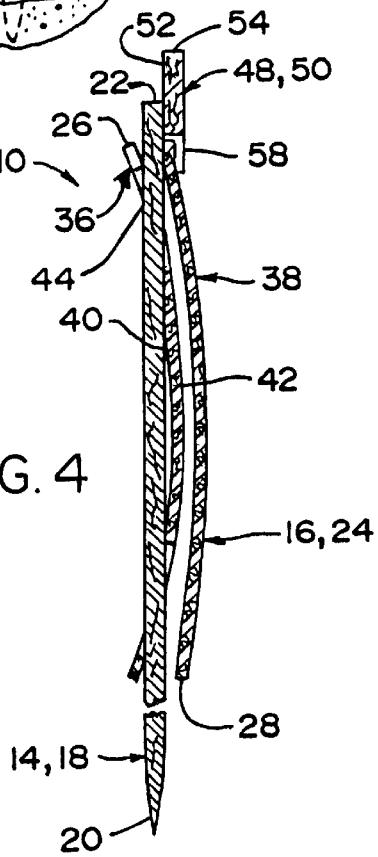
FIG. 4 is an enlarged diagrammatic cross sectional view taken along line 4—4 in FIG. 3.

The configuration of the memorial marker 10 can best be seen in FIGS. 2–4, and as such, will be discussed with reference thereto.

The memorial marker 10 comprises a stake 14 for staking in the grave 12.

The memorial marker 10 further comprises a panel 16 that is operatively connected to the stake 14.

The stake 14 is a rod 18.

The rod 18 is slender, elongated, and vertically-oriented.

The rod 18 has a lowermost end 20 that is conically pointed for sacking into the grave 12, an uppermost end 22, and a circumference.

The panel 16 is a card 24.

The card 24 is rectangular-shaped.

The card 24 has an uppermost long edge 26 that is horizontally-oriented, a lowermost long edge 28 that is horizontally-oriented, a leftmost short edge 30 that is vertically-oriented, a rightmost short edge 32 that is vertically-oriented, a fold line 34 that is vertically-oriented, parallel to, and disposed midway between, the leftmost short edge 30 of the card 24 and the rightmost short edge 32 of the card 24, and divides the card 24 equally into a right half 36 and a left half 38, a back surface 40, a front surface 42, an open mode, and a closed mode.

The back surface 40 of the card 24 has memorial indicia 43 thereon.

The front surface 42 of the card 24 has memorial indicia 45 thereon.

The right half 36 of the card 24 has a first throughslot 44 that is horizontally-oriented, extends just below, and parallel to, the uppermost long edge 26 of the card 24, is disposed midway between the rightmost short edge 32 of the card 24 and the fold line 34 of the card 24, and has a length.

The right half 36 of the card 24 further has a second throughslot 46 that is horizontally-oriented, extends just above, and parallel to, the lowermost long edge 28 of the card 24, is disposed midway between the rightmost short edge 32 of the card 24 and the fold line 34 of the card 24, has a length, and is parallel to, and vertically-aligned with, the first throughslot 44 in the right half 36 of the card 24.

The rod 18 extends vertically along the front surface 42 of the card 24, up through the second throughslot 46 in the right half 36 of the card 24, vertically along the rear surface 40 of the card 24, up through the first throughslot 44 in the right half 36 of the card 24, and back vertically along the front surface 42 of the card 24, with the lowermost end 20 of the rod 18 being disposed below the lowermost long edge 28 of the card 24, with the uppermost end 22 of the rod 18 being disposed above the uppermost long edge 26 of the card 24, and with the card 24 being vertically movable on the rod 18.

The length of each of the first throughslot 44 in the right half of the card 36 and the second throughslot 46 in the right half 36 of the card 24 is substantially equal to half the circumference of the rod 18 so as to allow the card 24 to move snugly along the rod 18.

The memorial marker 10 further comprises a cap 48 that selectively maintains the card 24 in the closed mode thereof, and which is attached to the circumference of the rod 18, at the uppermost end 22 of the rod 18, and is disposed above the uppermost long edge 26 of the card 24.

The cap 48 is a conventionally-oriented five point star 50.

The conventionally-oriented five point star 50 has a rear surface 52 that is attached to the circumference of the rod 18, at the uppermost end 22 of the rod 18.

The conventionally-oriented five point star 50 further has an uppermost pointed arm 54 that extends vertically upwardly from the circumference of the rod 18, at the uppermost end 22 of the rod 18.

The conventionally-oriented five point star 50 further has a pair of sidemost pointed arms 56 that extend horizontally outwardly from the circumference of the rod 18, at the uppermost end 22 of the rod 18.

The conventionally-oriented five point star 50 further has a pair of lowermost pointed arms 58 that depend skewly outwardly from the circumference of the rod 18, at the uppermost end 22 of the rod 18.

The pair of lowermost pointed arms 58 of the conventionally-oriented five point star 50 equidistantly straddle, and clear, the uppermost end 22 of the rod 18, and as a result thereof, allows the front half 38 of the card 24, at the uppermost long edge 26 of the card 24, to be releasably captured between the pair of lowermost pointed arms 58 of the conventionally-oriented five point star 50 and the uppermost end 22 of the rod 18 so as to maintain the card 24 in the closed mode thereof when the left half 38 of the card 24 is folded onto the right half 26 of the card 24, and the card 24 is moved vertically upwardly on the rod 18, and the left half 38 of the card 24 is flexed and engaged between the pair of lowermost pointed arms 58 of the conventionally-oriented five point star 50 and the uppermost end 22 of the rod 18.

It will be understood that each of the elements described above, or two or more together, may also find a useful application in other types of constructions differing from the types described above.

While the invention has been illustrated and described as embodied in a memorial marker for staking in a grave, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A memorial marker for staking in a grave, comprising:

a) a stake for staking in the grave; and b) a panel operatively connected to said stake, wherein said stake is a rod, wherein said rod has:

i) a lowermost end that is conically pointed for sacking into the grave;

ii) an uppermost end; and iii) a circumference, wherein said panel is a card, wherein said card is rectangular-shaped, wherein said card has:

A) an uppermost long edge that is horizontally-oriented;

B) a lowermost long edge that is horizontally-oriented;

C) a leftmost short edge that is vertically-oriented;

D) a rightmost short edge that is vertically-oriented;

E) a fold line that is vertically-oriented, parallel to, and disposed midway between, said leftmost short edge of said card and said rightmost short edge of said card, and divides said card equally into a right half and a left half;

F) a back surface;

G) a front surface;

H) an open mode; and

I) a closed mode, wherein said right half of said card has a first throughslot that is horizontally-oriented, extends Just below, and parallel to, said uppermost long edge of said card, is disposed midway between said rightmost short edge of said card and said fold line of said card, and has a length.

2. The marker as defined in claim 1, wherein said rod is:

a) slender;

b) elongated; and c) vertically-oriented.

3. The marker as defined in claim 1, wherein said back surface of said card has memorial indicia thereon.

4. The marker as defined in claim 1, wherein said front surface of said card has memorial indicia thereon.

5. The marker as defined in claim 1, wherein said right half of said card further has a second throughslot that is horizontally-oriented, extends just above, and parallel to, said lowermost long edge of said card, is disposed midway between said rightmost short edge of said card and said fold line of said card, has a length, and is parallel to, and vertically-aligned with, said first throughslot in said right half of said card.

6. The marker as defined in claim 5, wherein said rod extends vertically along said front surface of said card, up through said second throughslot in said right half of said card, vertically along said rear surface of said card, up through said first throughslot in said right half of said card, and back vertically along said front surface of said card, with said lowermost end of said rod being disposed below said lowermost long edge of said card, with said uppermost end of said rod being disposed above said uppermost long edge of said card, and with said card being vertically movable on said rod.

7. The marker as defined in claim 5, wherein said length of each of said first throughslot in said right half of said card and said second throughslot in said right half of said card is substantially equal to half said circumference of said rod so as to allow said card to move snugly along said rod.

8. The marker as defined in claim 1 further comprising a cap that selectively maintains said card in said closed mode thereof, and which is attached to said circumference of said rod, at said uppermost end of said rod, and is disposed above said uppermost long edge of said card.

9. The marker as defined in claim 8, wherein said cap is a conventionally-oriented five point star.

10. The marker as defined in claim 9, wherein said conventionally-oriented five point star has a rear surface that is attached to said circumference of said rod, at said uppermost end of said rod.

11. The marker as defined in claim 9, wherein said conventionally-oriented five point star further has an uppermost pointed arm that extends vertically upwardly from said circumference of said rod, at said uppermost end of said rod.

12. The marker as defined in claim 9, wherein said conventionally-oriented five point star further has a pair of sidemost pointed arms that extend horizontally outwardly from said circumference of said rod, at said uppermost end of said rod.

13. The marker as defined in claim 9, wherein said conventionally-oriented five point star further has a pair of lowermost pointed arms that depend skewly outwardly from said circumference of said rod, at said uppermost end of said rod.

14. The marker as defined in claim 13, wherein said pair of lowermost pointed arms of said conventionally-oriented five point star equidistantly straddle, and clear, said uppermost end of said rod, and as a result thereof, allows said left half of said card, at said uppermost long edge of said card, to be releasably captured between said pair of lowermost pointed arms of said conventionally-oriented five point star and said uppermost end of said rod so as to maintain said card in said closed mode thereof when said left half of said card is folded onto said right half of said card, and said card is moved vertically upwardly on said rod, and said left half of said card is flexed and engaged between said pair of lowermost pointed arms of said conventionally-oriented five point star and said uppermost end of said rod.

* * * * *